US005924374A

United States Patent [19]

Mori et al.

[11] Patent Number: 5,924,374

[45] Date of Patent: Jul. 20, 1999

[54] SEWING DATA PROCESSING DEVICE FOR SEWING MACHINE

[75] Inventors: Tomohiko Mori; Shoichi Taguchi; Yuji Iida, all of Nagoya, Japan

[73] Assignee: Brother Kogyo Kabushibi Kaisha, Nagoya, Japan

[21] Appl. No.: 09/038,057

[22] Filed: Mar. 11, 1998

[30] Foreign Application Priority Data

Mar. 11, 1997 [JP] Japan ..... 9-056322

[51] Int. Cl.[6] ..... D05B 19/12; D05B 21/00

[52] U.S. Cl. ..... 112/470.02; 112/102.5; 112/475.19; 364/470.09

[58] Field of Search ..... 112/470.02, 102.5, 112/470.06, 470.04, 475.19, 445, 458; 364/470.09, 470.07

[56] References Cited

U.S. PATENT DOCUMENTS 5,269,257 12/1993 Yamazaki ..... 112/470.02
5,460,109 10/1995 Adamski, Jr. et al. ..... 112/470.02 X

FOREIGN PATENT DOCUMENTS

A-8-299632 11/1996 Japan .

*Primary Examiner*—Peter Nerbun
*Attorney, Agent, or Firm*—Oliff & Berridge, PLC

[57] ABSTRACT

In a sewing data processing device, an LCD is switched to a pattern selecting screen when a user selects a desired stitch or sewing mode on a menu selecting screen. The user selects a desired embroidery pattern on the pattern selecting screen. When the selected embroidery pattern is a character pattern protected by copyright, a control device counts the number of times of use of the embroidery data of the selected character pattern to store data of the number of times of use in a non-volatile memory.

20 Claims, 11 Drawing Sheets

| |
|---|
| CHARACTER ATTRIBUTES OF FIRST EMBROIDERY PATTERN |
| CHARACTER ATTRIBUTES OF SECOND EMBROIDERY PATTERN |
| CHARACTER ATTRIBUTES OF THIRD EMBROIDERY PATTERN |
| CHARACTER ATTRIBUTES OF FOURTH EMBROIDERY PATTERN |
| ⋮ |
| ⋮ |
| LIMITED NUMBER OF TIMES OF SEWING OF FIRST EMBROIDERY PATTERN |
| LIMITED NUMBER OF TIMES OF SEWING OF SECOND EMBROIDERY PATTERN |
| LIMITED NUMBER OF TIMES OF SEWING OF THIRD EMBROIDERY PATTERN |
| LIMITED NUMBER OF TIMES OF SEWING OF FIRST EMBROIDERY PATTERN |
| ⋮ |
| ⋮ |
| SEWING DATA OF FIRST EMBROIDERY PATTERN |
| SEWING DATA OF SECOND EMBROIDERY PATTERN |
| SEWING DATA OF THIRD EMBROIDERY PATTERN |
| SEWING DATA OF FOURTH EMBROIDERY PATTERN |
| ⋮ |
| ⋮ |
| DISPLAY DATA OF FIRST EMBROIDERY PATTERN |
| DISPLAY DATA OF SECOND EMBROIDERY PATTERN |
| DISPLAY DATA OF THIRD EMBROIDERY PATTERN |
| DISPLAY DATA OF FOURTH EMBROIDERY PATTERN |
| ⋮ |
| ⋮ |

26

FIG. 9

| |
|---|
| NUMBER OF TIMES OF USE OF FIRST EMBROIDERY PATTERN |
| NUMBER OF TIMES OF USE OF SECOND EMBROIDERY PATTERN |
| NUMBER OF TIMES OF USE OF THIRD EMBROIDERY PATTERN |
| NUMBER OF TIMES OF USE OF FOURTH EMBROIDERY PATTERN |
| ⋮ |
| ⋮ |

24

FIG. 10

SEWING DATA PROCESSING DEVICE FOR SEWING MACHINE

BACKGROUND OF THE INVENTION

1. Field of the Invention

This invention relates to a sewing data processing device provided, for example, in a sewing machine, for processing sewing data containing a number of types of stitches and more particularly, to such a sewing data processing device processing sewing data containing embroidery patterns.

2. Description of the Related Art

There has recently been provided a household embroidery machine storing data of a number of embroidery patterns such as pictures and letters. A desired one or more of the embroidery patterns are selected by a user so that the selected embroidery patterns are formed on a workpiece cloth. Embroidery data (sewing data) required for executing the above-described embroidery forming operation is stored in an internal memory such as ROM provided in the machine or an external memory medium such as an external memory card. Upon selection of a desired embroidery pattern by the user, the embroidery data corresponding to the selected embroidery pattern is read from the internal memory or external ROM card. An embroidery forming operation is executed on the basis of the read embroidery data.

The assignee of the present invention has supplied embroidery machines of the above-described type and recently, further supplied external memory cards called "embroidery cards" storing embroidery data corresponding to embroidery patterns such as various character patterns including characters in comics, animations, television programs, television games and movies, and images of robots, vehicles and logos. The users can enjoy embroidering character patterns at home. These characters are usually protected by copyrights. The term, "character," will hereinafter have the meaning as mentioned above throughout the description.

In order to meet variety of users' demands, the above-described embroidery machine is desired to have a larger number of selectable embroidery patterns and a larger number of types of them. In this case, however, there is a possibility that it may take the users much time to find out a desired embroidery pattern or that a selecting operation may be troublesome. Furthermore, the embroidery patterns includes those which are selectable but are not always used. Additionally, since tastes or choice of the users vary with time, the embroidery patterns include those which were previously popular but are not always used at present. Accordingly, the embroidery patterns which are not always used needs to be eliminated from the internal memory or the embroidery card, or replaced by new ones which are popular at present. With this, the users' demands can be met and a sewing machine with a fine operability or embroidery cards can be supplied.

The above-mentioned embroidery data of the character patterns aims in principle at the users' enjoying embroidering at home for private purposes. No problem arises when embroideries of the character patterns formed with the above-described embroidery machine are privately used. However, the embroidering operation can be executed at a large number of times when the embroidery machine is supplied with the embroidery data. Accordingly, there is a possibility that a large number of character pattern embroideries formed with the embroidery machine may unfairly be used for business purposes or commercial purposes. However, the embroidery machine is not provided with means for distinguishing between private use of the formed embroideries and the use of the embroideries for business purposes or commercial purposes. These circumstances are applied to overall devices for storing and processing the embroidery data as well as the embroidery machines.

SUMMARY OF THE INVENTION

Therefore, an object of the present invention is to provide a sewing data processing device and sewing machine which are provided with functions of processing sewing data necessary for execution of the sewing operation and which can provide histories of a number of types of stitches including embroidery patterns and ordinary stitches, which stitches are selectively used.

The present invention provides a sewing data processing device comprising sewing data storage means for storing sewing data used for execution of a sewing operation, processing means reading the sewing data from the sewing data storage means for processing the read sewing data, and count storage means counting the number of times of use of the sewing data for storing data of the number of times of use of the sewing data.

According to the above-described device, what types of stitches are frequently used can be grasped on the basis of the number of times of use of the sewing data stored in the count storage means. The sewing data preferably includes sewing data used for execution of an embroidery forming operation forming an embroidery pattern on a workpiece cloth. Particularly in this case, the types of embroidery patterns popular with the user can be grasped on the basis of the number of times of use of the sewing data stored in the count storage means. Furthermore, the sewing data is basically restricted to the private use. However, when the sewing data is used for the business purposes or commercial purposes, the number of times of use would become larger than in the private use of the sewing data. Consequently, a judgment can be made on the basis of the data stored in the count storage means as to whether the sewing data has been used for private purposes, or business purposes or commercial purposes. The device may further comprise a device body and the sewing data storage means may comprise an external storage means detachably attached to the device body.

When the sewing data is a specified embroidery pattern such as a character pattern protected by copyright, to use the sewing data for the business purposes or commercial purposes without consent of a copyright owner constitutes an unfair practice. Accordingly, only the numbers of times of use of the character patterns need to be frequently checked. Furthermore, a mere trial sewing for several seconds needs to be distinguished from a usual sewing operation. Accordingly, the count storage means preferably counts the number of times of use of the sewing data when use of the sewing data fulfills a predetermined requirement.

The count storage means further preferably counts the number of times of use of the sewing data when execution of the embroidery forming operation has been completed. Consequently, the count storage means can eliminate a case where the embroidery is not completed, for example, the case where the embroidery pattern is selected but the embroidery forming operation is not actually executed on the basis of the selected pattern, or the case where the embroidery forming operation is interrupted in the midst thereof.

The sewing data processing device may further comprise reset means for resetting the number of times of use of the sewing data stored in the count storage means when a predetermined condition is met. Furthermore, the device may further comprise informing means for informing that the sewing data is restricted to a private use by a user. The informing means can serve for the user to recognize that the sewing data of the embroidery patterns are prohibited from being used for the business purposes or commercial purposes. Additionally, the device may further comprises a device body. In this case, the sewing data storage means includes internal storage means provided in the device body and the informing means executes an informing operation when power is supplied to the device.

The invention also provides a sewing machine comprising a sewing needle provided for executing a sewing operation, judging means for judging whether a predetermined condition has been met, and count storage means counting the number of times of a reciprocal movement of the sewing needle for execution of the sewing operation for storing data of the counted number of times when the judging means judges that the predetermined condition has been met.

The count storage means preferably counts the number of times of the reciprocal movement of the sewing needle for the execution of the sewing operation when the sewing operation has been executed for a predetermined period of time. The data of the number of times of the reciprocal movement of the sewing needle stored in the count storage means is capable of being reset, for example, by a special operation by a service person. The count storage means preferably accumulates the numbers of times of the reciprocal movement of the sewing needle with respect to all sewing operations.

BRIEF DESCRIPTION OF THE DRAWINGS

Other objects, features and advantages of the present invention will become clear upon reviewing the following description of preferred embodiments thereof, made with reference to the accompanying drawings, in which:

FIG. 9 shows data structure in an external ROM card;

FIG. 10 shows data structure in a non-volatile memory; and

DETAILED DESCRIPTION OF THE PREFERRED EMBODIMENTS

Figure 1:
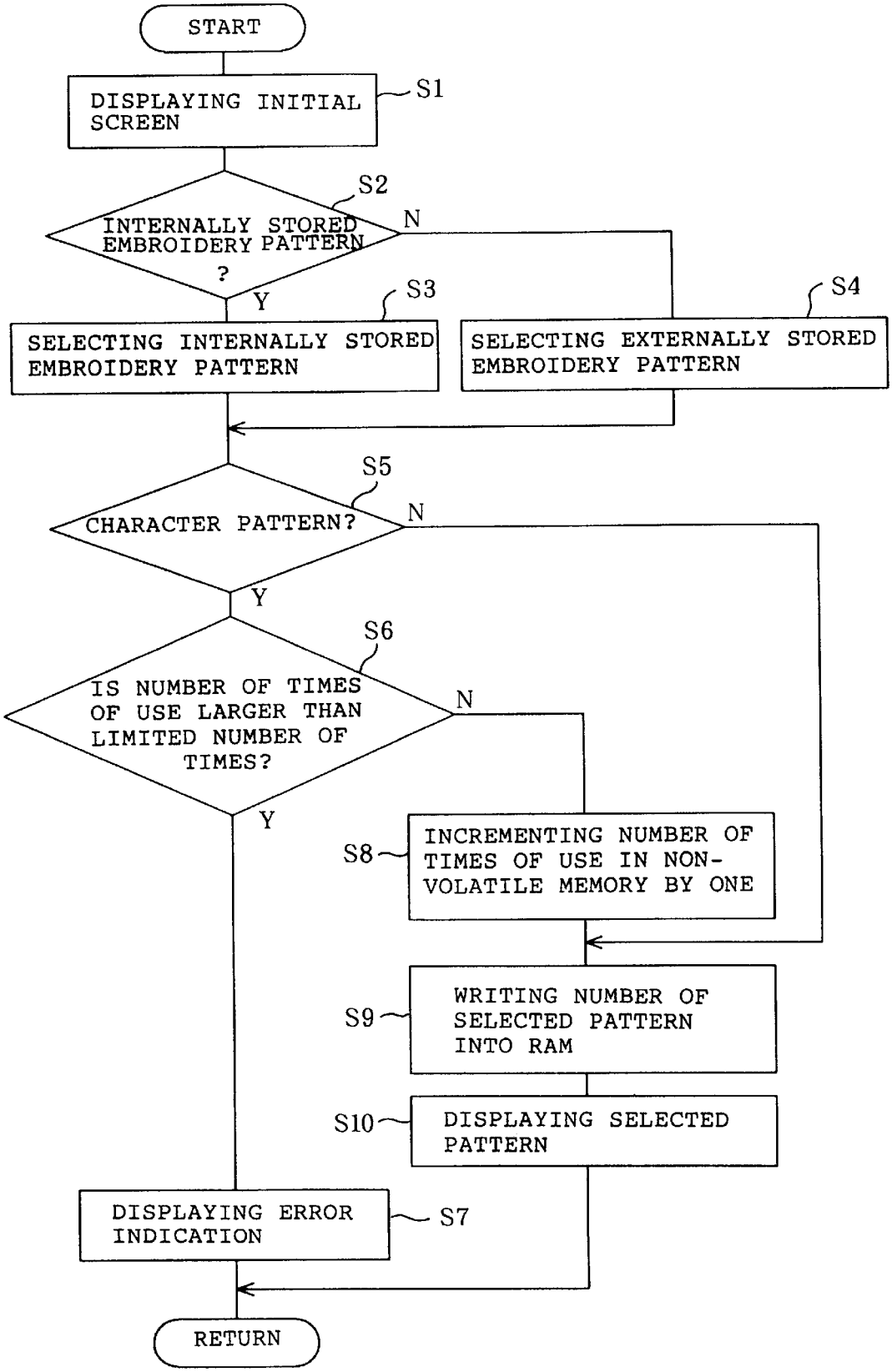
FIG. 1 is a flowchart showing processing procedures in the case of selection of an embroidery pattern in an embroidery machine of a first embodiment in accordance with the present invention.
Figure 2:
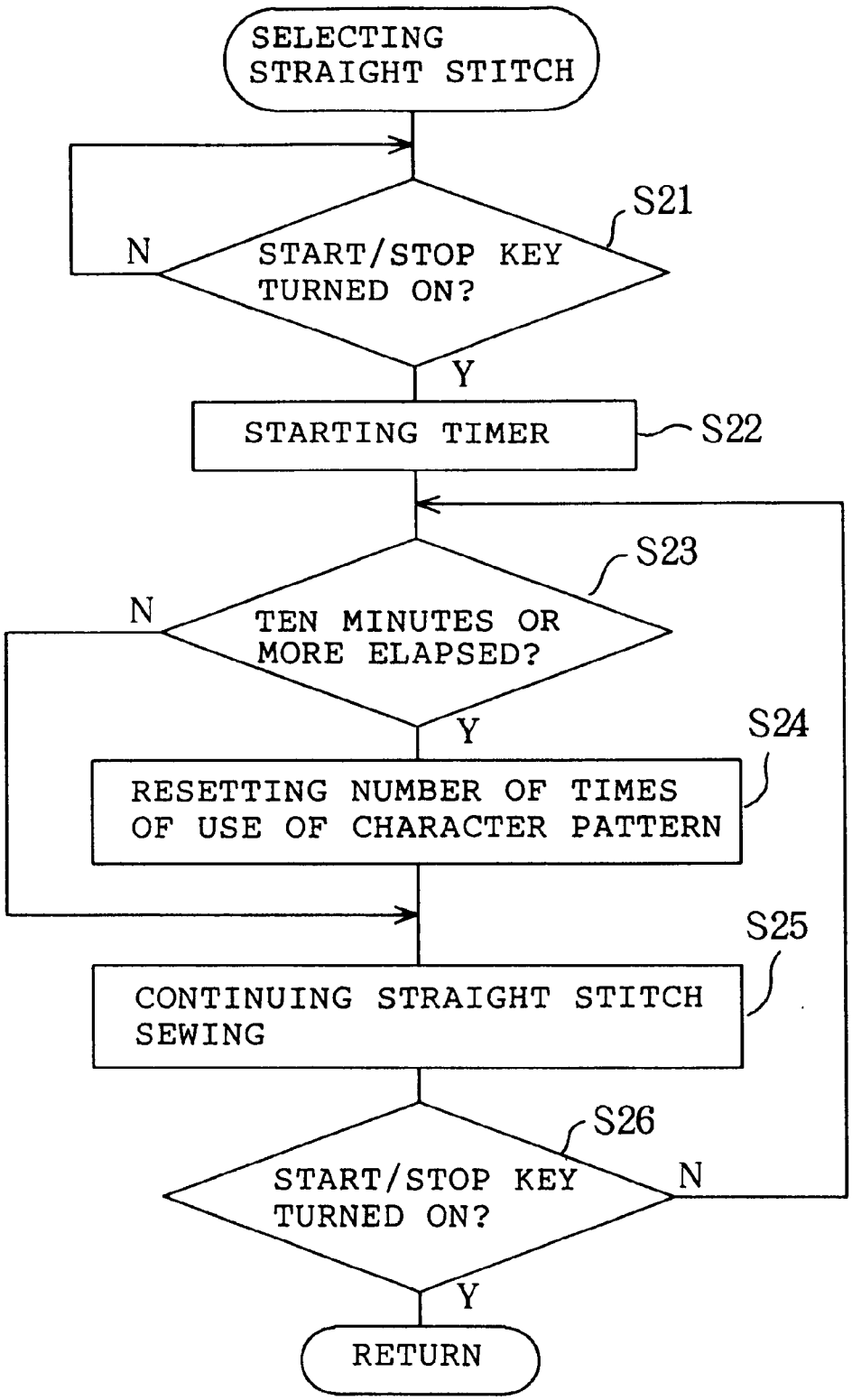
FIG. 2 is a flowchart showing processing procedures in execution of straight stitch.
Figure 3:
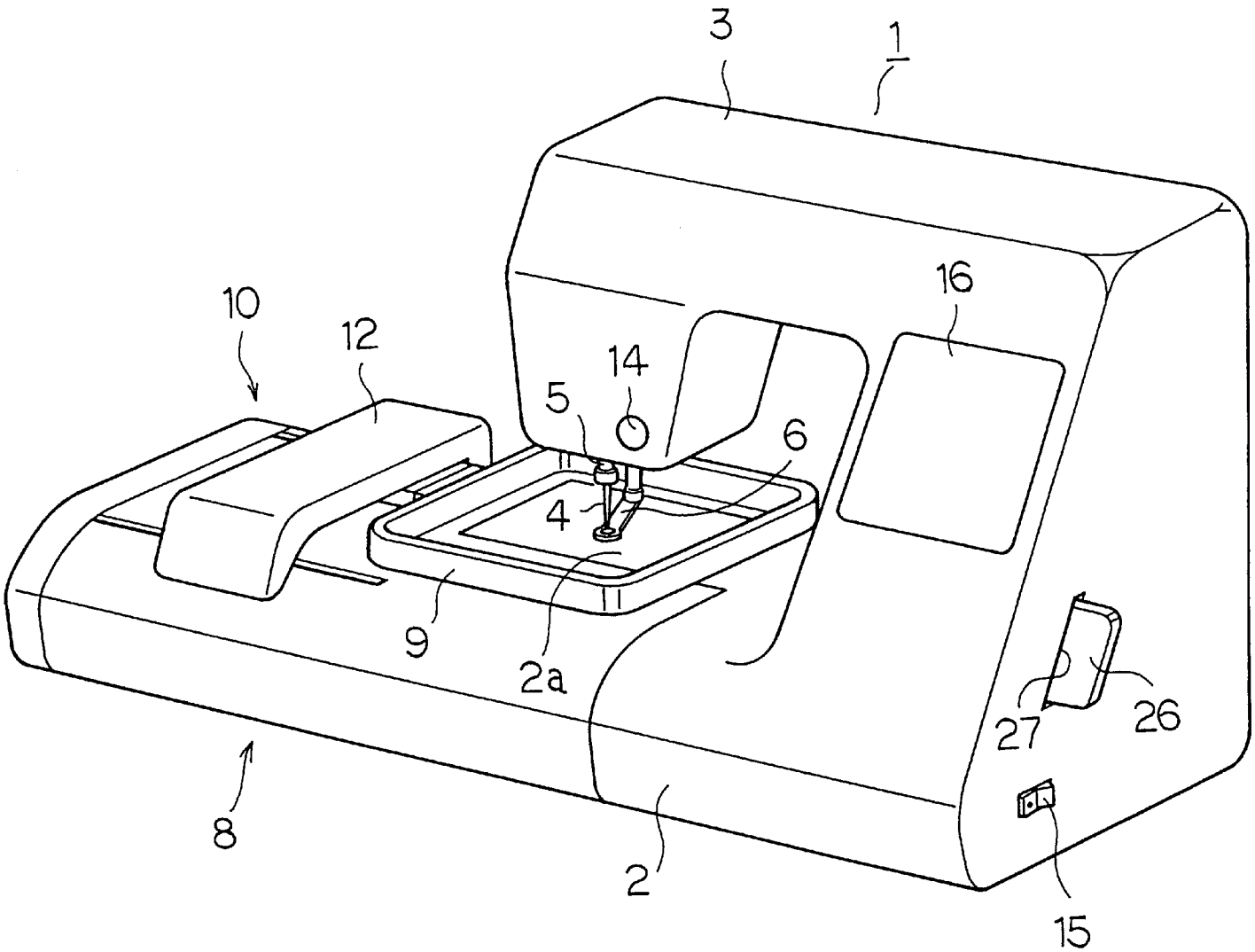
FIG. 3 is a perspective view of the embroidery machine.

A first embodiment will be described with reference to FIGS. 1 to 10. The present invention is applied to a household embroidery machine in the first embodiment. The embroidery machine has a function as a sewing data processing device. Referring first to FIG. 3, an overall embroidery machine is schematically shown. The embroidery machine comprises a main body 1 including a bed 2 and an arm 3 formed integrally with and extending over the bed 2. A needle bar 5 having a sewing needle 4 is provided on a distal end of the arm 3. The distal end of the arm 3 is also provided with a ring-shaped presser foot 6 through which the sewing needle 4 passes. The presser foot 6 applies a suitable force to a workpiece cloth (not shown) to bias a part of the workpiece cloth through which the needle 4 passes. A throat plate 2*a* is mounted on an upper surface of the bed 2 so as to correspond to the needle bar 5. A shuttle mechanism (not shown) is provided at a position under the throat plate 2*a* in the bed 2. The needle bar 5, the shuttle mechanism, etc. are synchronously driven by a sewing machine motor 7 (shown only in FIG. 4) so that a sewing operation is executed.

An embroidering unit 8 is detachably attached to a left-hand end of the bed 2. The embroidering unit 8 comprises an embroidery frame 9 for holding the workpiece cloth and an embroidery frame moving mechanism 10 for moving the embroidery frame 9 horizontally, that is, in an X-axis direction and a Y-axis direction. The embroidery frame 9 includes an outer frame and an inner frame between which the workpiece cloth is sandwiched, so that the workpiece cloth can be held tightly stretched inside the embroidery frame 9 between the frame and the throat plate 2*a*.

Figure 4:
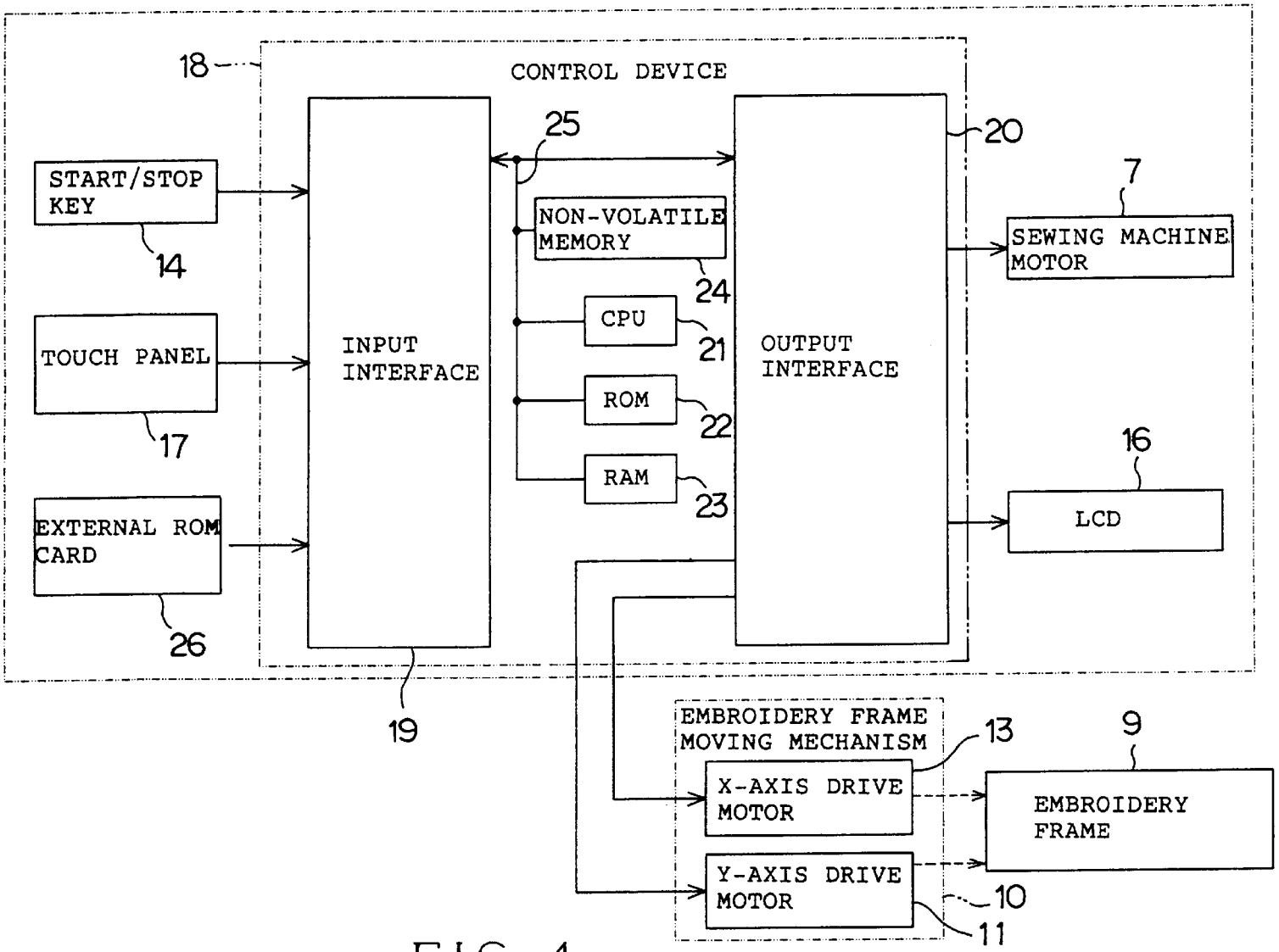
FIG. 4 is a block diagram showing an electrical arrangement of the embroidery machine.
Figure 5:
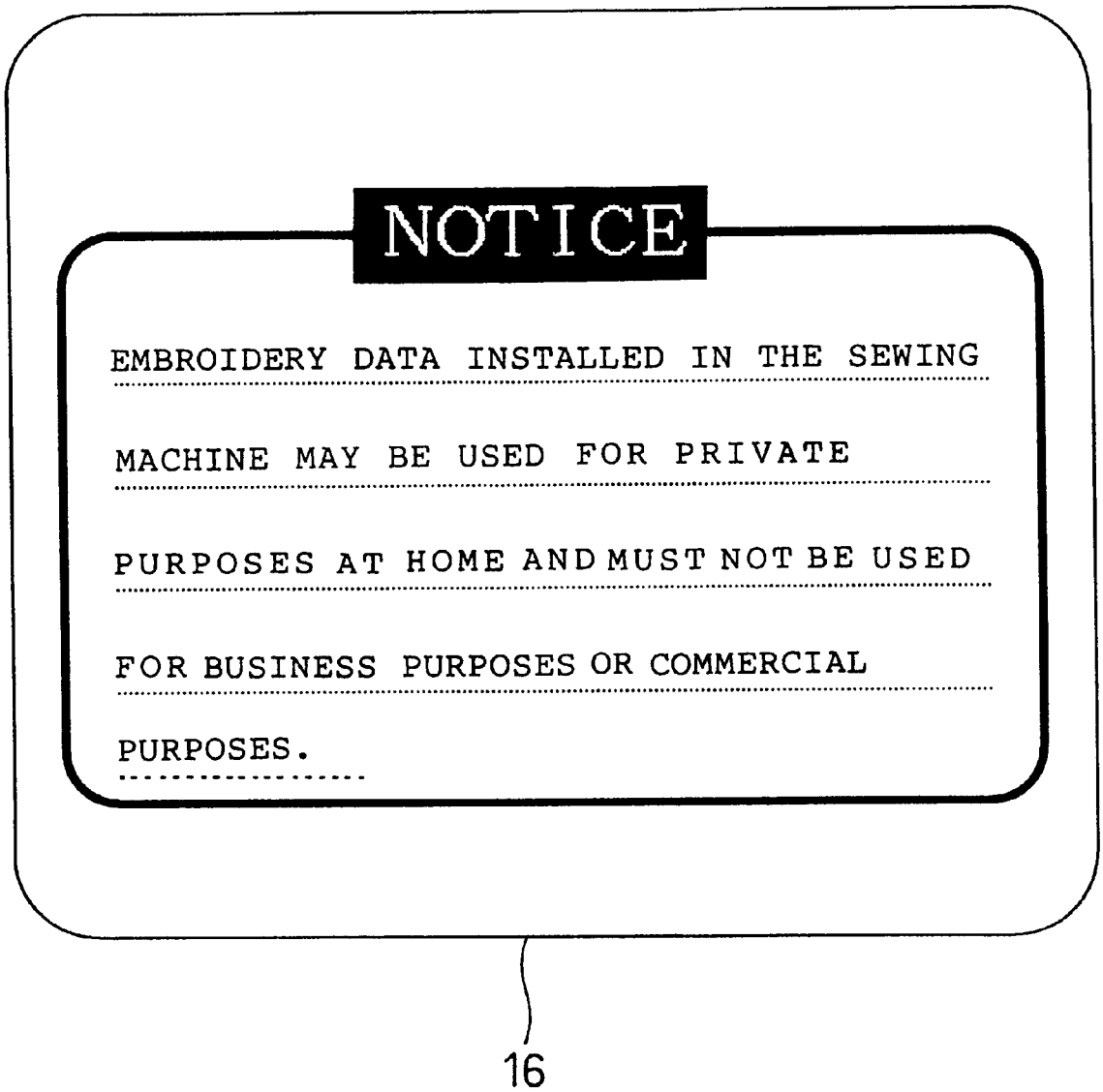
FIG. 5 shows a "NOTICE" screen displayed on a liquid crystal display (LCD)

The embroidery frame moving mechanism 10 comprises a movable member 12 moved by an X-axis drive motor 13 (shown only in FIG. 4) freely in the X-axis direction, that is, leftward and rightward as viewed in FIG. 4. The embroidery frame 9 is detachably attached to the movable member 12 to be moved by a Y-axis drive motor 11 in the Y-axis direction, that is, forward and backward as viewed in FIG. 4. Consequently, the workpiece cloth held by the embroidery frame 9 can be moved by the embroidery frame moving mechanism 10 to an optional position based on an intrinsic X-Y coordinate system. An embroidering operation is performed when the needle bar 5, shuttle mechanism, presser foot, etc. are driven by the respective drive mechanisms while the workpiece cloth is moved freely relative to the needle bar 5 by the embroidery frame moving mechanism 10.

The embroidery machine of the embodiment is capable of performing a variety of ordinary sewing modes such as straight stitching, zigzag stitching and overcast stitching as well as embroidering. In case that the embroidering is not carried out, the embroidering unit 8 is removed from the bed 2 to be replaced by a flat table (not shown) for the ordinary sewing modes. The workpiece cloth is fed forward and backward by a feed dog (not shown) provided below the throat plate 2*a* while the sewing needle 4 is raised. The needle bar 5 (sewing needle 4) is rocked leftward and rightward by a needle rocking mechanism such that the zigzag stitch etc. can be sewn.

A start/stop key 14 is provided on a front surface of the distal end of the arm 3 as shown in FIG. 3. A power switch 15 is provided on the lower right-hand side surface of the machine main body 1. A card insertion slot 27 is provided in the right-hand side wall of the main body 1. An external ROM card 26 is inserted into the card insertion slot 27. The external ROM card 26 serves as external storage means as will be described later.

A monochrome liquid crystal display (LCD) 16 is provided on the front surface of the arm 3. The LCD 16 serves as display means for displaying a variety of patterns and messages. A touch panel 17 (shown only in FIG. 4) is provided on the surface of the LCD 16. The touch panel 17 includes various operation keys as well known in the art. The touch panel 17 comprises a number of transparent electrodes arranged vertically and horizontally and detects where the user touches it, as well known in the art.

Referring to FIG. 4, a microcomputer-based control device 18 is provided in the machine main body 1 for controlling the various mechanisms described above. The control device 18 includes an input interface 19, output interface 20, CPU 21, ROM 22, RAM 23, and a non-volatile memory 24 such as EEPROM all connected by a bus 25. The ROM 22 stores control programs for controlling the embroidering operation and other ordinary sewing operations of the embroidery machine, and a control program for controlling display of the LCD 16, and a data processing program for performing various data processes such as readout and edit of embroidery data. The ROM 22 further stores embroidery data for determining outlines of a number of embroidery patterns including picture patterns and ornamental patterns formed by relatively simple shapes and for symbols and letters such as English alphabet, numerals and Japanese "kana." The ROM 22 thus serves as internal storage means in the invention.

In the embodiment, the embroidery data stored in the ROM 22 includes sewing data required for the embroidering, and display data formed from bit map data required for display of each pattern on the LCD 16. The sewing data is stored in the ROM 22 in the form of coordinate data for indicating an outline or contour of each pattern. When the embroidering is to be executed, calculations are performed on the coordinate data to develop it into data indicating each needle location, that is, amounts of movement of the workpiece cloth in the X-axis and Y-axis directions for each stitch. Furthermore, the same data can be used for both sewing data and display data. Alternatively, either one set of the data can be stored and developed into the other set of data.

The sewing machine motor 7, X-axis and Y-axis drive motors 13 and 11 of the embroidery frame moving mechanism 10, LCD 16, etc. are connected to the output interface 20 so as to be controlled by the control device 18. The touch panel 17 and start/stop key 14 are connected to the input interface 19 so that detection signals from the touch panel 17 and switch signals from the start/stop key 14 are delivered to the control device 18. The above-mentioned external ROM card 26 is adapted to be connected to the input interface 19.

The external ROM card 26 stores data of embroidery patterns differing from those stored in the ROM 22, that is, embroidery data of a plurality of character patterns each of which is protected by copyright. The external ROM card 26 further stores data of attributes of the characters of the respective embroidery patterns or data indicating as to whether the characters are protected by copyright, and data of the limited number of times of sewing (100 times, for example). The limited number of times of sewing is set on the basis of frequency in use of the sewing machine. FIG. 9 shows the data structure in the external ROM card 26. Regarding the embroidery patterns stored in the ROM 22, too, data of attributes of the characters and data of the limited number of times of sewing are stored in ROM 22 together with the embroidery data.

Based on the programs stored in the ROM 22 and selecting operations performed on the touch panel 17 by the user, the control device 18 controls the various mechanisms of the embroidery machine so that the embroidering and other ordinary sewing operations are executed. As will be apparent from the following description, the control device 18 controls the LCD 16 to display thereon a menu selecting screen (see FIG. 6) and a pattern selecting screen (see FIG. 7) containing a number of patterns displayed. The user can select a desired embroidery pattern or ordinary sewing mode by touching the touch panel 17. Furthermore, the control device 18 controls the LCD 16 to display a NOTICE screen (see PIG. 5) upon supply of power to the embroidery machine. The NOTICE screen informs that the stored embroidery data may be used for private purposes at home and must not be used for business purposes or commercial purposes. The LCD 16 thus serves as informing means in the invention. Additionally, the control device 16 counts or accumulates, by software, the number of times of use or selection of the embroidery data of each character pattern and stores the count in the non-volatile memory 24, as will be described later. The control device 18 and non-volatile memory 24 thus serve as count storage means in the invention. The non-volatile memory 24 stores data of the number of times of use (or selection) of each of the embroidery patterns as shown in FIG. 10. When the number of times of use of the embroidery data of the character pattern exceeds the limited number of times of sewing, the control device 18 prohibits acceptance of selection of the embroidery pattern and controls the LCD 16 to display an error indication (not shown) thereon. Furthermore, under a predetermined condition or when the straight stitch which has a highest frequency in use among the normal sewing modes is executed continuously for a predetermined period of time, for example, 10 minutes or more, the control device 18 resets, to zero, the number of times of use the data of which is stored in the non-volatile memory 24. The control device 18 thus serves as reset means in the invention.

Figure 6:
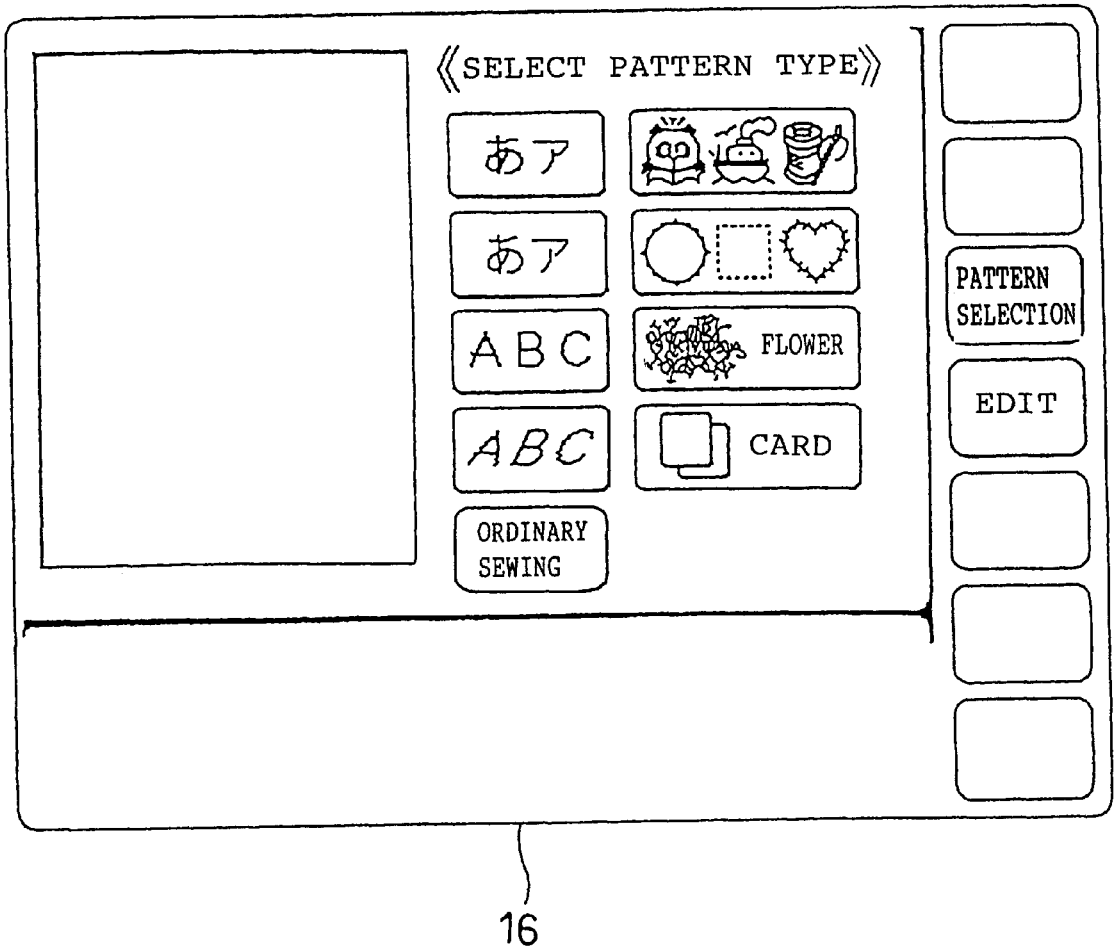
FIG. 6 shows a menu selecting screen (initial screen) displayed on the LCD.

The operation of the embroidery machine will be described with reference to FIGS. 1 and 2. Selection of the embroidery pattern will first be described. The LCD 16 displays the NOTICE screen (see FIG. 5) for a predetermined period of time, for example, several seconds when the power switch 15 is turned on. This NOTICE screen displays a message as described above. Subsequently, the LCD 16 displays a menu selecting screen (initial screen) at step S1 as shown in FIG. 6. The menu selecting screen displays nine selected items, that is, eight items obtained by classifying a number of embroidery patterns and one item of ordinary sewing. An item of CARD represents an embroidery pattern whose data is stored in the external ROM card 26, which embroidery pattern will be referred to as "externally stored embroidery pattern." The other items on the screen represent the embroidery patterns stored in the ROM 22 respectively, which embroidery patterns will be referred to as "internally stored embroidery patterns." The user operates the touch panel 17 to select a desired item.

Figure 7:
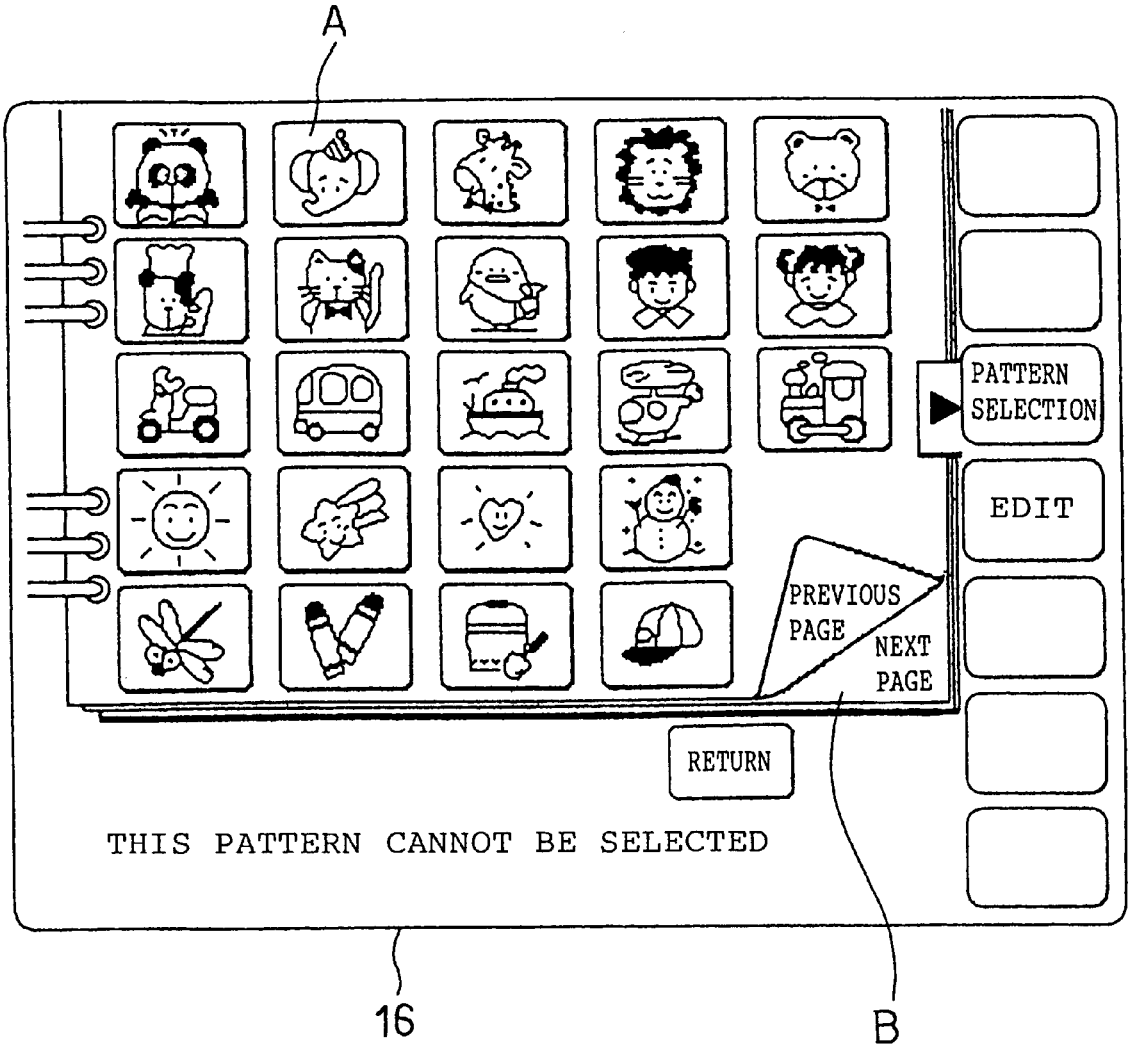
FIG. 7 shows an example of pattern selecting screen displayed on the LCD.

Assume now that the user selects a right-hand upper item of picture pattern in FIG. 6. Since the selected item is an internally stored embroidery pattern (YES at step S2), the screen of the LCD 16 is switched from the menu selecting screen of FIG. 6 to a pattern selecting screen concerning the selection of picture pattern as shown in FIG. 7 on the basis of the embroidery data (display data) stored in the ROM 22 (step S3). The pattern selecting screen as shown in FIG. 7 displays a number of picture patterns A including panda, elephant, giraffe, lion, etc. For example, the panda designates a first embroidery pattern, the elephant a second embroidery pattern, and the giraffe a third embroidery pattern. Since the number of embroidery patterns displayed on a single screen is limited, the pattern selecting screen is provided over a plurality of pages. The pattern selecting screen is switched from one page to another when a page switch key B provided on a right-hand lower corner of the screen is operated.

On the other hand, when the user selects the item, CARD, on the menu selecting screen (NO at step S2), a pattern selecting screen (not shown) is displayed on the basis of the embroidery data (display data) stored in the external ROM card 26 at step S4. Subsequently, the user operates the touch panel 17 to select a desired embroidery pattern. Then, a judgment is made at step S5 as to whether the selected embroidery pattern is a character pattern. When the selected embroidery pattern is a character pattern, a judgment is made at step S6 as to whether the number of times of use of the selected embroidery pattern stored in the external ROM card 26 exceeds the limited number of times (100 times). When the number of times of use exceeds the limited number of times (YES at step S6), the selection of the embroidery pattern is not accepted, and the error indication is displayed at step S7. Furthermore, when the number of times of use is at or below the limited number of times (NO at step S6), the data of the number of times of use stored in the non-volatile memory 24 is incremented by one at step S8, and the sewing data of the selected embroidery pattern is written into the RAM 23 at step S9. Furthermore, the LCD 16 is switched to a confirmation/edit screen (not shown) at step S10. On the other hand, processes at steps S9 and S10 are executed when the selected embroidery pattern is not a character pattern (NO at step S5).

The above-mentioned confirmation/edit screen is displayed in order that a location of the embroidery formed on the workpiece cloth inside the embroidery frame 9, the color of a thread to be used, etc. may be set or confirmed. The above-described embroidery selecting operation can be repeated so that a plurality of embroidery patterns are combined together. Upon confirmation of the location of the embroidery on the confirmation/edit screen, the user operates the start/stop key 14 so that the embroidery forming operation is executed.

Figure 8:
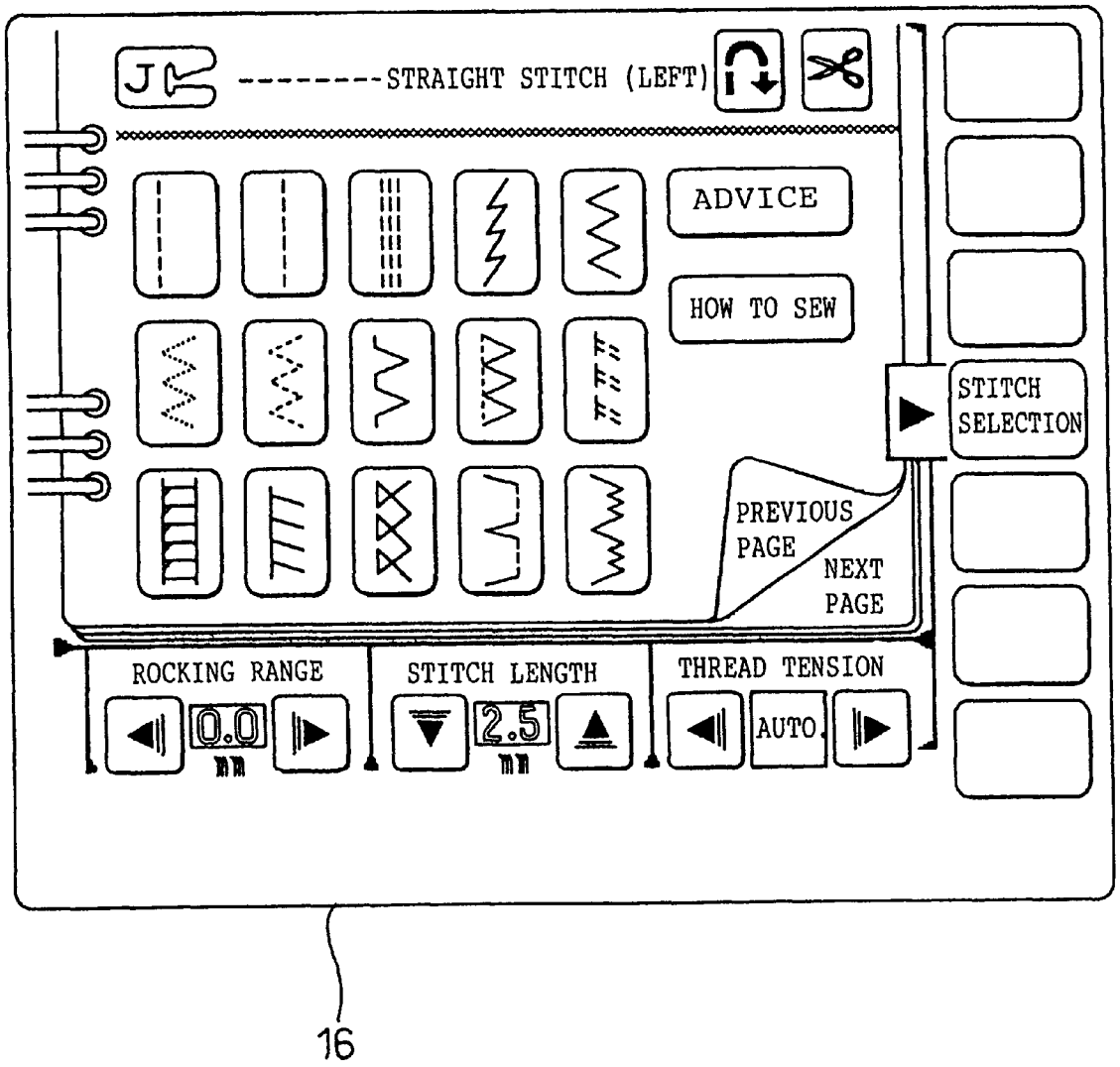
FIG. 8 shows an example of a selecting screen concerning the practical stitch on the LCD.

The user selects an item, ORDINARY SEWING, on the menu selecting screen (see FIG. 6) of the LCD 16 when wishing to execute the ordinary sewing (straight stitch). The LCD 16 then displays an ordinary sewing selecting screen as shown in FIG. 8. A number of stitches concerning the ordinary sewing are displayed on the ordinary sewing selecting screen. The straight stitch has been selected in the initial state of the ordinary sewing selecting screen. Accordingly, the selecting operation is performed only when the stitches other than the straight stitch are selected. When the start/stop key 14 is operated in the condition where the straight stitch has been selected (YES at step S21), the sewing operation is started and a timer (not shown) is activated (step S22). A judgment is made at step S23 as to whether ten minutes has elapsed. The sewing operation for the straight stitch is continued when ten minutes have not elapsed (NO at step S23). Upon elapse of ten minutes (YES at step S23), the numbers of times of use of the embroidery data of all the character patterns stored in the non-volatile memory 24 are reset to zeros respectively at step S24 and thereafter, the sewing operation concerning the straight stitch is continued (step S25). The sewing operation is continued until the start/stop key 14 is operated (step S26).

According to the foregoing embodiment, the control device 18 increments, by one, the number of times of use of the character pattern whose data is stored in the non-volatile memory 24 when the character pattern has been selected. Accordingly, when the embroidery machine is carried into a maker or dealer for repair or replacement to a new one, the data stored in the non-volatile memory 24 is inspected so that the number of times of use of each character pattern can be found.

The selection of the character pattern is not accepted and the error indication is displayed when the number of times of use of the character pattern exceeds the limited number of times of sewing. Consequently, the embroidery data can be prevented from being used in excess of the limited number of times of sewing. Furthermore, the embroidery data of the character patterns can be prevented from being used for the business purposes or for the commercial purposes.

There is a possibility that the number of times of use of the embroidery data of a character pattern may exceed the limited number of times of sewing when the user uses the embroidery machine for a long period of time at home to normally form the embroidery of the character pattern. This bona fide use of the embroidery data should not be regarded as equivalent to the use for the business purposes or commercial purposes. In this case, the bona fide user may also use the sewing machine in the ordinary sewing mode for a long period of time. In view of the above-described situation, the control device 18 resets the data of number of times of use stored in the non-volatile memory 24 to zero when the straight stitch having a highest frequency in use in the ordinary sewing modes is executed continuously for ten minutes or longer. This renders the number of times of use stored in the non-volatile memory 24 smaller than the number of times of actual use of the embroidery data of character pattern. Consequently, the prohibition of the selecting operation or display of error indication can be prevented when the bona fide user uses the embroidery data of character pattern in excess of the limited number of times.

In the foregoing embodiment, the NOTICE screen is displayed on the LCD 16 when power is supplied to the sewing machine. This screen can achieve a certain deterrent effect for the users intending to use the sewing machine for the purposes other than the private amusement.

Figure 11:
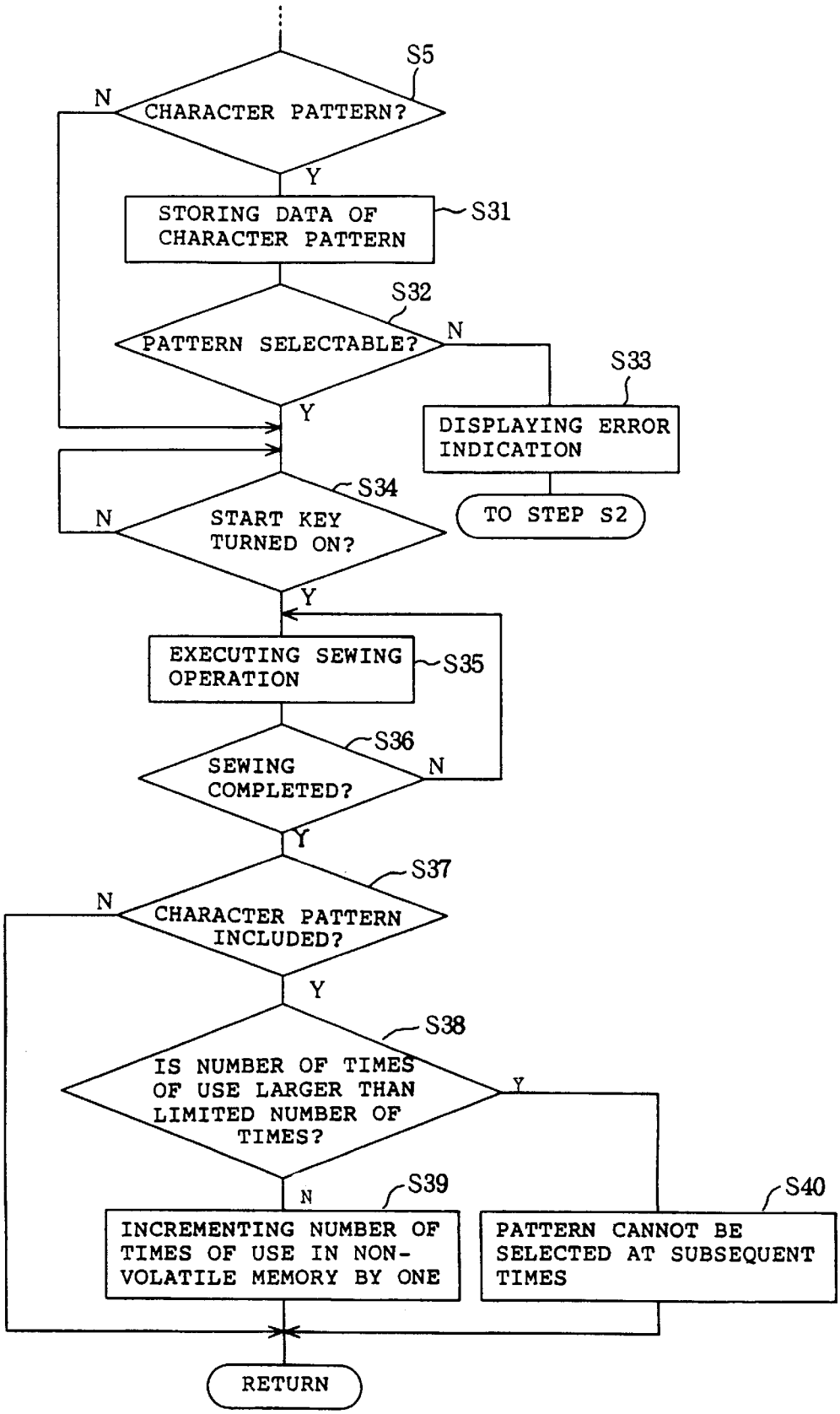
FIG. 11 is a flowchart showing processing procedures in the case of selection of an embroidery pattern in an embroidery machine of a second embodiment in accordance with the present invention.

FIG. 11 illustrates a second embodiment of the invention. Differences between the first and second embodiments will be described. Identical parts are labeled by the same reference symbols as in the first embodiment. In the foregoing embodiment, the number of times of use of the embroidery data is counted when the character pattern has been selected. In the second embodiment, instead, the number of times of use of the embroidery data is counted when the embroidery forming operation regarding the character pattern has been completed. More specifically, as shown in FIG. 11, a judgment is made as to whether the formed embroidery pattern contains a character pattern upon completion of the embroidery forming or sewing operation executed on the basis of the embroidery data. The data of the number of times of use stored in the non-volatile memory 24 is incremented by the number of the character patterns when the formed embroidery pattern contains a character pattern. Furthermore, in a case where the number of times of use exceeds the limited number of times of sewing, the acceptance of the selecting operation is prohibited and an error indication is displayed when the character pattern is subsequently selected. In the second embodiment, the non-volatile memory 24 may store data of the number of times of embroidery forming operation in use of the embroidery data of character pattern. More specifically, the embroidery forming operation is executed once even when the embroidery data used in one embroidery forming operation contains a plurality of character patterns.

Accordingly, the data of number of times of embroidery forming operation is incremented one.

According to the second embodiment, the constitution thereof can eliminate a case where a character pattern is selected but the embroidery forming operation is not actually executed on the basis of the selected character pattern. Instead of counting the number of times of use of the embroidery data at the time of completion of the embroidery forming operation, the number of times of use of the embroidery data may be counted before completion of the embroidery forming operation, that is, immediately before completion of the embroidery forming operation or in the midst of the embroidery forming operation after elapse of a predetermined time from the start thereof. Furthermore, the number of times of use of the embroidery data may be counted before a final stop stitch is formed with the embroidery portion being completed.

The number of times of use of the embroidery data is counted to be stored for each type of embroidery pattern in the foregoing embodiments. However, the number of times of use may be counted to be stored for each group of embroidery patterns. In this case, the limited number of times of use is set to be larger than in the case where the number of times of use of the embroidery data is counted for each type of embroidery pattern. Furthermore, the number of times of use of the embroidery data may be stored in the external ROM card 26 as well as in the non-volatile memory 24 of the control device 18. Furthermore, although the number of times of use of the embroidery data is sequentially incremented in the foregoing embodiments, an upper limit of the number of times of use may be set as a variable and may sequentially be decremented for each use of the embroidery data. In this case, the use of the embroidery data is prohibited when the number of times of use is decremented to zero.

The foregoing embodiments may be modified as follows. The display of the NOTICE screen should not be limited to the time of power supply to the embroidery machine and may be executed at any time. Furthermore, the selecting operation is not accepted and the error indication is displayed in the foregoing embodiments when the number of times of use of the sewing data (embroidery data) of the character pattern exceeds the limited number of times of sewing. The number of times of use of the sewing data of the character pattern may only be counted to be stored, instead. The number of times of use may be stored regarding the sewing data of all the embroidery patterns, instead of regarding the sewing data of the character patterns. Furthermore, the number of times of use of the sewing data of ordinary sewing may also be counted to be stored in addition to the numbers of times of use of the sewing data of embroidery patterns. In this case, the sewing data of the ordinary sewing includes data indicative of operating patterns of the needle bar 5 and feed dog, namely, an amount of needle rocking motion of the needle bar 5 and an amount of feed of the feed dog. Consequently, the non-volatile memory 24 can store the data of the numbers of times of use of the sewing data with respect to the embroidery patterns and all the ordinary sewing modes selectably provided in the sewing machine. Accordingly, when the embroidery machine is carried into the maker or dealer, the number of times of use of the sewing data regarding each of the ordinary sewing modes is inspected so that the ordinary sewing modes the user often uses can be found.

The following timing for the count of the number of times of use of the sewing data may be considered. That is, the number of times of use of the sewing data may be counted when:

1. the embroidery forming operation has been executed with a thread of one color with respect to each character pattern;

2. the thread of one color has been changed to that of another color with respect to each character pattern;

3. a predetermined combination of a plurality of character patterns has been selected, for example, a combination of a hero or heroine character and his sweetheart or her lover character, or a hero or heroine character and his or her rival character;

4. a specified pattern, for example, a specific profile or the letter "C" of the term, "copyright" has been sewn;

5. each character pattern has been selected and the start/stop key 14 has then been turned on;

6. an end code of the sewing data of each character pattern has been read;

7. stop data contained in the sewing data of each character pattern immediately before finish of sewing has been read;

8. the sewing data of each character pattern has been read from the ROM 22 or the external ROM card 26;

9. the sewing data of each character pattern has been read to be written into the RAM 23;

10. a predetermined sewing speed or frame moving pattern set in the sewing data of each character pattern has been executed;

11. code data contained in the sewing data of character pattern has been read;

12. the embroidery machine has been turned to a mode in which each character pattern can be selected;

13. a total number of times of vertically reciprocal movement of the needle for sewing or a rotational speed of arm shaft has reached a predetermined value;

14. power is supplied to the embroidery machine or an original point of the embroidery frame has been detected; or 15. the external ROM card has been inserted into the insertion slot.

In the foregoing embodiments, the data of numbers of times of use stored in the count storage means (non-volatile memory 24) are reset when the straight stitch is executed continuously for the predetermined period of time. However, the count storage means may be reset under the following conditions:

1. The count storage means may be reset when the number of times of the sewing operation in a week is at or below a predetermined number of times;

2. Information about failure of the machine is displayed to urge the user to telephone the maker or dealer when the sewing machine is in a prohibited sewing state. When the maker receives a call from the user, they may instruct the user in a specified operation (for example, code) for resetting;

3. The names of the family of a purchaser are secretly registered when the embroidery machine is sold. The count storage means may be reset when the embroidering is executed so that one of the names of the registered family is embroidered;

4. The count storage means may be reset when ordinary sewing modes or the forming of an embroidery other than the character patterns is executed;

5. The count storage means may be checked to be reset when a service personnel inspects the embroidery machine; or 6. The count storage means may be reset when power is not supplied to the embroidery machine for a predetermined period of time, for example, a week.

An upper limit value of the number of times of resetting operation may be set so that the limitation to the number of times of use of the embroidery data is doubled. Furthermore, the limited number of times of use may differ from one embroidery pattern to another.

In the foregoing embodiments, the invention is applied to the case where the limited number of times of use of the embroidery data is provided so that use of the embroidery data is prohibited when the limited number of times of sewing is reached. However, the invention may be applied to a case where a rental fee is imposed according to the number of times of use.

The limited numbers of times of use of the character patterns are uniformly set on the basis of frequency in use of the embroidery machine in the foregoing embodiments. However, the limited numbers of times may be set according to the conditions of use of the individual sewing machines by the respective users. For example, the limited numbers of times may be increased as compared with usual ones when the user offers to use the character patterns more times than usual because the user has many children. In this case, it may be premised that a surcharge is imposed on the user.

Furthermore, the invention may be applied to a case where embroidery data of a character pattern for trial embroidering in which the embroidery can be formed once is stored in the internal and external storage means. In this case, the limited number of times of use is one. Upon completion of a one time of the embroidery forming operation, the embroidery data is rendered non-selectable, and an advertisement for the embroidery pattern, types of the embroidery card, etc. may be displayed.

Furthermore, the invention may be applied to sewing machines for industrial or business use ad well as to the household embroidery machine. In the industrial or business use, too, the embroidery data can be prevented from an excessive use. The invention may further be applied to an apparatus independent of the sewing machine, for example, an embroidery unit (apparatus for moving a workpiece cloth) as disclosed in Japanese patent publication No. 8-299632-A. The disclosed embroidery unit is detachably attached to a sewing machine and provided with a ROM for storing the embroidery data. The invention may further be applied to an apparatus for treating only with data for origination and editing of embroidery data, etc. and overall apparatus for processing embroidery data, for example, apparatus for converting data format of embroidery data.

In the foregoing embodiments, additionally, the acceptance of selecting operation is prohibited and the indication of error is displayed when the number of times of use exceeds the limited number of times. However, the following processes may be performed, instead. These processes are described in detail in Japanese patent application No. 9-56321 filed by the assignee of the present invention on the same day that the Japanese patent application on which the present application is based. First, regarding the processes in which the embroidery machine is switched into an operation mode differing from a proper mode:

1. Power supply to the embroidery machine may be prohibited;

2. A buzzer may be kept activated;

3. The screen of the LCD 16 may be brightened or dimmed to a maximum extent;

4. The external ROM card 26 may be prohibited from being inserted into the machine body 1 or from being detached therefrom;

5. The acceptance of the external ROM card 26 may be prohibited by a software arrangement;

6. The ordinary sewing mode may be maintained even when the embroidering unit 8 is attached to the machine body 1; or 7. Power may be turned off when the external ROM card 26 is inserted into the machine body 1.

The following Nos. 8 to 10 are examples in which the embroidery pattern is prohibited from being selected:

8. The transition to the pattern selecting screen may be prohibited;

9. The pattern selecting keys may be prohibited from being displayed or crosses may be displayed on the pattern selecting keys; or 10. The size of the pattern or quantity of data may falsely exceed the limit.

The following Nos. 11 to 20 are examples in which the sewing operation cannot normally be executed though the pattern can be selected:

11. The acceptance of the starting operation may be prohibited after the pattern selection;

12. A thread sensor may be switched into a false error state;

13. A machine motor may be switched into a false locked condition;

14. The presser foot 6 may be held in a raised state;

15. Specified patterns may slowly be sewn;

16. The embroidery frame 9 may be rendered immovable during the sewing;

17. The thread may be prohibited from being drawn out or may be drawn out in an improper manner;

18. Unnecessary thread cutting may frequently be executed;

19. Drive power may be reduced so that the pulse motor is easily led into loss of synchronism; or 20. Layout, edit and help functions may be restricted.

The following Nos. 21 to 27 are other examples:

21. When the number of times of use has reached the limited number of times of sewing, a specified error message may be displayed together with the telephone and facsimile numbers so that a contact with the maker or dealer is urged. In this case, the maker or dealer may cancel the prohibition in case that the user has good faith;

22. A message informing of illegality may be displayed or the sewing operation may be prohibited from being stopped;

23. A serial number may be stored in the external ROM card 26 when the number of times of use has reached the limit value, so that the external ROM card cannot be used with another sewing machine;

24. Codes may be stored in both of the machine and the external ROM card 26 respectively so that the sewing operation is executed only when the codes agree with each other, whereas a prohibiting process is carried out when the codes disagree with each other;

25. A formed embroidery may contain a code indicative of a production number of the sewing machine or external ROM card so that the user can be specified by the formed embroidery;

26. The data stored in the external ROM card 26 or the card itself may be destroyed when the number of times of use has reached a limit value; or 27. The external ROM card 26 may falsely be destroyed or the destruction of the card may be displayed when a normal external ROM card 26 is inserted into an unjustly used sewing machine.

The number of times of use of each sewing data is counted and stored by the count storage means (the control device 18 and non-volatile memory 24) in the foregoing embodiments. The number of times of a vertically reciprocal movement of the sewing needle 4 for the execution of the sewing operation may be counted to be stored, instead. The count storage means may count the number of times of the reciprocal movement of the sewing needle 4 when a predetermined condition is met, for example, when the sewing operation has been executed for a predetermined period of time. In this case, the control device 18 constitutes judging means for judging whether the predetermined condition has been met. Furthermore, the count storage means may count the number of times of the reciprocal movement of the sewing needle 4 for every type of the stitch or may accumulate the numbers of times of the reciprocal movement of the sewing needle 4 with respect to all sewing operations.

The sewing data may be supplied to the sewing machine by means of wireless communication or internet communication system.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing data processing device comprising:

sewing data storage means for storing sewing data used for execution of a sewing operation;

processing means reading the sewing data from the sewing data storage means for processing the read sewing data; and count storage means counting the number of times of use of the sewing data for storing data of the number of times of use of the sewing data.

2. A device according to claim 1, wherein the sewing data includes sewing data used for execution of an embroidery forming operation for forming an embroidery pattern on a workpiece cloth.

3. A device according to claim 1, wherein the count storage means counts the number of times of use of the sewing data when use of the sewing data fulfills a predetermined requirement.

4. A device according to claim 2, wherein the count storage means counts the number of times of use of the sewing data when use of the sewing data fulfills a predetermined requirement.

5. A device according to claim 2, wherein the count storage means counts the number of times of use of the sewing data when the embroidery forming operation has been completed.

6. A device according to claim 1, further comprising reset means for resetting the number of times of use of the sewing data stored in the count storage means when a predetermined condition is met.

7. A device according to claim 2, further comprising reset means for resetting the number of times of use of the sewing data stored in the count storage means when a predetermined condition is met.

8. A device according to claim 2, further comprising informing means for informing that the sewing data is limited to a private use by a user.

9. A device according to claim 8, which further comprises a device body, wherein the sewing data storage means includes internal storage means provided in the device body and the informing means executes an informing operation when power is supplied to the device.

10. A device according to claim 1, which further comprises a device body and wherein the sewing data storage means comprises an external storage means detachably attached to the device body.

11. A sewing machine comprising:

a sewing machine body;

a sewing device for executing a sewing operation;

a sewing data storage circuit for storing a multitude of sewing data;

a processing circuit reading from the sewing data storage circuit the sewing data for processing the read sewing data;

a control circuit for controlling the sewing device so that the sewing operation is executed on the basis of the sewing data processed by the processing circuit; and a count storage circuit counting the number of times of use of the sewing data for storing data of the number of times of use of the sewing data.

12. A storage medium for storing a program for operating a sewing data processing device, the program accomplishing the functions of:

processing means reading a predetermined sewing data from sewing data storage means for processing the sewing data;

counting means for counting the number of times of use of the sewing data; and storage means for storing data of the number of times of use of the sewing data counted by the counting means.

13. A sewing machine comprising:

a sewing needle provided for executing a sewing operation;

judging means for judging whether a predetermined condition has been met; and count storage means counting the number of times of a reciprocal movement of the sewing needle for execution of the sewing operation for storing data of the counted number of times when the judging means judges that the predetermined condition has been met.

14. A sewing machine according to claim 13, wherein the count storage means counts the number of times of the reciprocal movement of the sewing needle for the execution of the sewing operation when the sewing operation has been executed for a predetermined period of time.

15. A sewing machine according to claim 13, wherein the data of the number of times of the reciprocal movement of the sewing needle stored in the count storage means is capable of being reset.

16. A sewing machine according to claim 13, wherein the data of the number of times of the reciprocal movement of the sewing needle stored in the count storage means is reset by a special operation by a service person.

17. A sewing machine according to claim 13, wherein the count storage means accumulates the numbers of times of the reciprocal movement of the sewing needle with respect to all sewing operations.

18. A method of operating a sewing data processing device, comprising the steps of:

reading a predetermined sewing data from sewing data storage means and processing the sewing data;

counting the number of times of use of the sewing data; and storing data of the counted number of times of use of the sewing data in count storage means.

19. The method according to claim 18, wherein the data of the number of times of use stored in the count storage means is capable of being reset.

20. The method according to claim 18, wherein the data of the number of times of use stored in the count storage means is reset when a predetermined condition is met.

* * * * *